US009963934B2

(12) United States Patent
Hsieh

(10) Patent No.: US 9,963,934 B2
(45) Date of Patent: May 8, 2018

(54) DEVICE AND METHOD FOR CONTROLLING SPEED OF ROLLING DOOR

(71) Applicant: Chung-Hsien Hsieh, New Taipei (TW)

(72) Inventor: Chung-Hsien Hsieh, New Taipei (TW)

( * ) Notice: Subject to any disclaimer, the term of this patent is extended or adjusted under 35 U.S.C. 154(b) by 28 days.

(21) Appl. No.: 15/393,344

(22) Filed: Dec. 29, 2016

(65) Prior Publication Data

US 2018/0094482 A1 Apr. 5, 2018

(30) Foreign Application Priority Data

Oct. 3, 2016 (TW) ..... 105131849 A

(51) Int. Cl.
*E06B 9/68* (2006.01)

(52) U.S. Cl.
CPC ..... *E06B 9/68* (2013.01); *E06B 2009/6809* (2013.01); *E06B 2009/6845* (2013.01)

(58) Field of Classification Search
CPC ..... E06B 9/68; E06B 2009/6845; E06B 2009/6809
See application file for complete search history.

(56) References Cited

U.S. PATENT DOCUMENTS 6,082,433 A * 7/2000 Vafaie ..... E06B 9/68 160/310
6,640,494 B2 * 11/2003 Hormann ..... E06B 9/68 49/138
7,208,897 B2 * 4/2007 Hotto ..... G05B 19/042 318/282
7,982,422 B2 * 7/2011 Meewis ..... E06B 9/262 318/445
2008/0224642 A1 * 9/2008 Rodriguez ..... E05F 15/668 318/466
2013/0020969 A1 * 1/2013 Leivenzon ..... E06B 9/68 318/16
2016/0090772 A1 3/2016 Hsieh
2017/0192404 A1 * 7/2017 Barralon ..... G05B 19/045

FOREIGN PATENT DOCUMENTS

TW M314253 U 6/2007

OTHER PUBLICATIONS

TW Office Action dated Dec. 6, 2017 in corresponding Taiwan application (No. 105131849).

* cited by examiner

*Primary Examiner* — Blair M Johnson
(74) *Attorney, Agent, or Firm* — McClure, Qualey & Rodack, LLP

(57) ABSTRACT

A device and method for controlling the speed of a rolling door is disclosed. The door panel is controlled to accelerate or decelerate by means of the real-time rolling speed of the door panel, such that speed control is applicable to door panels of different specifications. When the real-time rolling speed of a door panel reaches a predetermined acceleration value, a control module actuates the driving module to speed up opening or closing of the door panel. When the real-time rolling speed of the door panel reaches a predetermined deceleration value, the control module controls the driving module to speed down opening or closing of the door panel; when the real-time rolling speed of the door panel is in between the acceleration value and the deceleration value, the control module actuates the driving module to maintain the opening or closing speed of the rolling door at current value.

10 Claims, 4 Drawing Sheets

DEVICE AND METHOD FOR CONTROLLING SPEED OF ROLLING DOOR

FIELD OF THE INVENTION

The present invention relates to a device and method for controlling the speed of a rolling door, particularly to a rolling door speed control device and method for controlling the speed of opening or closing the rolling door.

BACKGROUND OF THE INVENTION

Nowadays, the average door operator is set up to open or close the rolling door at a constant speed. That is, a rolling door is operated at a constant speed. However, in cases where the opening or closing stroke of the rolling door is relatively long, the waiting time will be lenghty, and both time and energy would be wasted. Therefore, a rolling door system with a variable operation speed is urgently needed by the industries and the public. There are existing art that make use of absolute positions to control the rolling speed of a rolling door, in which the rolling speed is accelerated or decelerated as a predetermined position is reached. However, such control mode is not flexible enough to cope with different requirements and changes, and is only applicable to a rolling door that is to be fully opened or closed.

In general, specifications of door operators are fixed, but specifications of door panels may be different to cope with different requirements, and on-site conditions for installing the rolling doors. Therefore, the size, type or material of the door panel may be different, which will result in weight difference. However, door panels of different weights will have different operation loads. If the rolling speed of the rolling door is controlled by only the absolute position, the door operator may be damaged due to overload during acceleration, or may result in risk as the operation speed of the door operator may be too fast due to underweight of the load.

With the recent improvement in the technology of detecting the real-time position of the rolling door, it is now possible to provide a rolling door system with variable operation speed. With reference to U.S. patent publication No. 2016/0090772 A1 entitled "Door Operator System Capable of Detecting a Current-Time Position of a Movable Barrier/Door Operator System Having a Device for Detecting Real-time Position of a Rolling Door", a first angular position sensing unit is used to measure a rotational angle of an output shaft of a motor or a door shaft of a rolling door directly or indirectly, and a revolution counting unit is used to count the number of revolutions for the output shaft of the motor or the door shaft of the rolling door, to thereby calculate a real-time (current-time) absolute position of the rolling door.

However, even though it is possible to calculate the real-time absolute position of the rolling door, there are still difficulties in the application of the concept to control the operation speed of the rolling door system. The present invention overcomes all the problems and successfully implements a rolling door system with variable operation speed.

SUMMARY OF THE INVENTION

An object of the present invention is to provide a device and method for controlling the speed of a rolling door to control the opening or closing of a door panel at a variable speed in order to improve the operation speed of the door panel.

To achieve the above purpose, a rolling door speed control device according to the invention is adapted for controlling a driving module to open or close a door panel. The device comprises essentially a speed detection module and a control module. The speed detection module is adapted for detecting a real-time rolling speed of the door panel, while the control module is electrically connected with the speed detection module and the driving module. When the real-time rolling speed of a door panel reaches a predetermined acceleration value, a control module actuates the driving module to speed up opening or closing of the door panel. When the real-time rolling speed of the door panel reaches a predetermined deceleration value, the control module controls the driving module to speed down opening or closing of the door panel; when the real-time rolling speed of the door panel is in between the acceleration value and the deceleration value, the control module actuates the driving module to maintain the opening or closing speed of the rolling door at current value.

Accordingly, the rolling door speed control device according to the invention may accelerate or decelerate the operation of the door panel based on the real-time rolling speed of the door panel. Even for door operators of the same specification, the speed may still be controlled according to different specifications (for example, weight) of door panels. In particular, the opening speed of the door panel may be raised automatically to its maximum value that lies within a safe load range of the door operator. For example, in the case of opening a door panel, as the load of the door panel is heavier in the beginning, the real-time rolling speed of the door panel will be below an acceleration value under a fixed power output of the driving module. In the course of opening the door panel, the load of the door panel decreases gradually, which will render the real-time rolling speed increases gradually. Once the acceleration value is reached, the control module will control the driving module to speed up the opening of the door.

Preferably, the speed detection module of the rolling door speed control device according to the invention comprises a real-time position detector adapted to detect a real-time absolute position of the door panel; and the speed detection module may obtain the real-time rolling speed of the door panel in accordance with the variation amount per second of the real-time absolute position. In other words, the present invention obtains the real-time rolling speed of the door panel simply by calculating the variation amount per second of the real time absolute position based on the absolute position of the door panel sensed by the real-time position detector.

Furthermore, the control module of the rolling door speed control device according to the invention may set up a position before a terminal point of an opening or closing stroke of the door panel, at which position the opening or closing speed of the door panel is configured to commence deceleration according to the real-time rolling speed of the door panel detected by the speed detection module. Specifically, different deceleration strokes are needed for different real-time rolling speeds. As such, the faster the real-time rolling speed is, the more ahead of the position where deceleration commences is.

Furthermore, the control module of the rolling door speed control device according to the invention determines if the door panel is in the opening stroke or the closing stroke based on the fluctuations/variations of the real-time absolute position detected by the real-time position detector. In other words, the trend of change associated with the real-time absolute position as detected by the real-time position detector may be used to determine if the door panel is in the opening stroke or closing stroke. The control module will immediately cease the operation when it is detected that the door panel moves in a wrong direction.

Moreover, the control module of the rolling door speed control device according to the invention comprises a memory unit configured to store the acceleration value, the deceleration value and a range of safety speed values; wherein the acceleration and deceleration values are within the range of safety speed values. When the real-time rolling speed of the door panel goes beyond the range of the safety speed values, the control module actuates the driving module to stop the opening or closing of the door panel. In other words, in the present invention, a range of safety speed values may be further set up. When the real-time rolling speed of the door panel goes beyond or below the range of safety speed values, that is when the operation speed is too fast or slow to render the door panel to be out of control, the control module will take over the control of the driving module to stop the opening or closing of the door panel immediately, in order to prevent any damage or danger.

To achieve the above purpose, the present invention provides a method for controlling the speed of a rolling door adapted for controlling a driving module to open or close a door panel. The method comprises the steps of: (A) providing a control module to actuate a speed detection module to detect a real-time rolling speed of the door panel; and (B) configuring the control module to control the driving module to open or close the door panel according to the following conditions; wherein, when the real-time rolling speed of a door panel reaches a predetermined acceleration value, a control module actuates the driving module to speed up opening or closing of the door panel. When the real-time rolling speed of the door panel reaches a predetermined deceleration value, the control module controls the driving module to speed down opening or closing of the door panel; when the real-time rolling speed of the door panel is in between the acceleration value and the deceleration value, the control module actuates the driving module to maintain the opening or closing speed of the rolling door at current value.

The method for controlling the speed of a rolling door according to the invention may speed up or speed down the operation of the door panel based on the real-time rolling speed of the door panel to control the speed within a safe load range in accordance with different specifications of the door panels. As such, the system operates stably and safely, and the waiting time for opening/closing the door panel may be reduced significantly to save energy effectively.

Preferably, in step (A) of the method for controlling the speed of a rolling door according to the invention, the speed detection module may provide a real-time rolling speed of the door panel in accordance with a variation amount per second of a real-time absolute position of the door panel detected by a real-time position detector.

Additionally, in the method for controlling the speed of a rolling door according to the invention, the control module may set up a position before a terminal point of an opening or closing stroke of the door panel, at which position the opening or closing speed of the door panel is configured to commence deceleration according to the real-time rolling speed of the door panel detected by the speed detection module.

Further, in the method for controlling the speed of a rolling door according to the invention, the control device may determine the door panel is in the opening or closing stroke based on the fluctuations/variation of the real-time absolute position detected by the real-time position detector.

Moreover, in the method for controlling the speed of a rolling door according to the invention, when the real-time rolling speed of the door panel goes beyond a range of the safety speed values, the control module actuates the driving module to stop the opening or closing of the door panel.

DESCRIPTION OF THE PREFERRED EMBODIMENT

Figure 1:
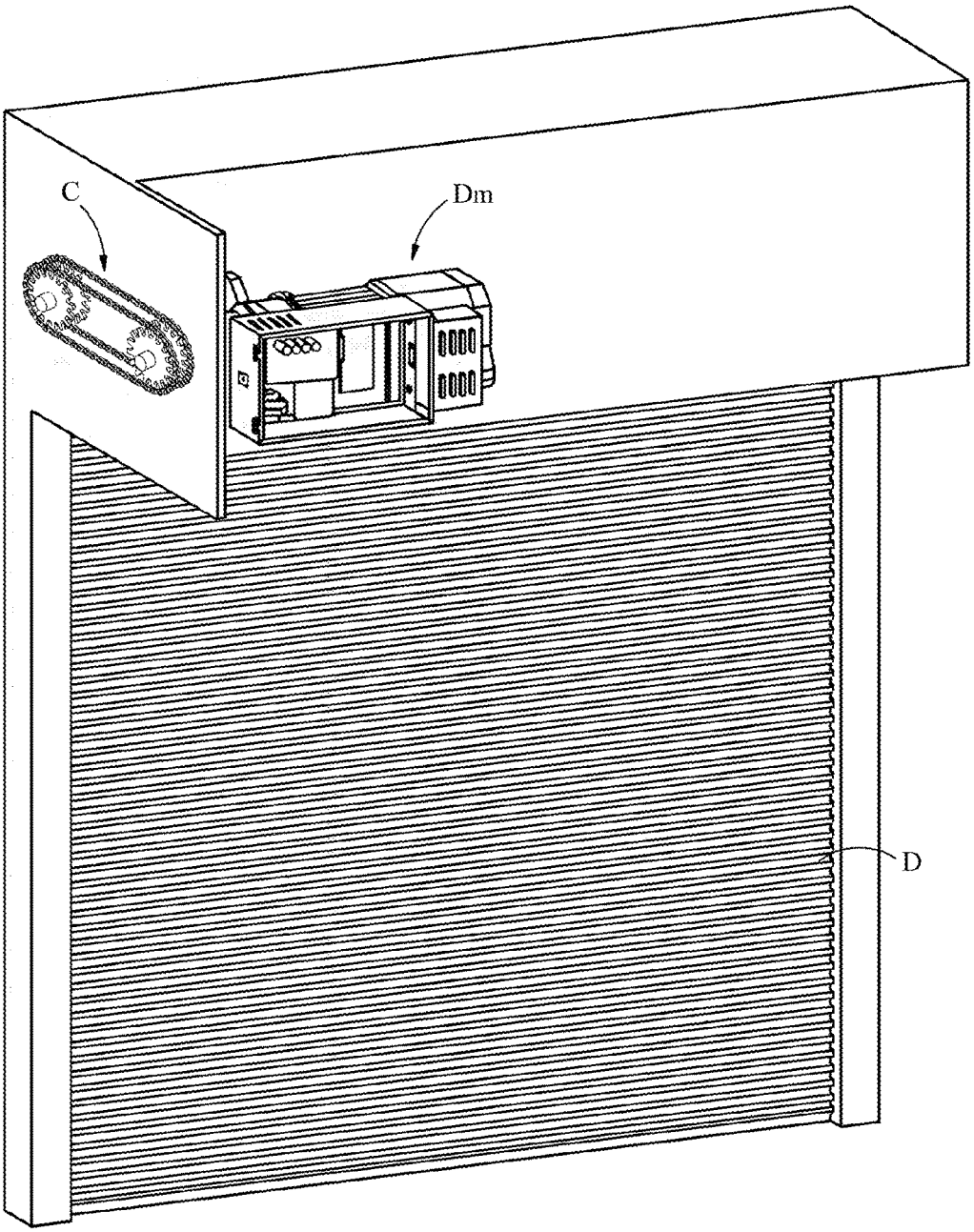
FIG. 1 is an overall schematic view of a preferred embodiment according to the invention.

Before describing a rolling door speed control device and the control method thereof according to the invention in detail in the embodiment, it is noted particularly that, like elements are designated by the same numeral in the description below. Further, drawings of the invention are only illustrative and are not necessarily drawn to scale, and not all details are shown in the drawings.

Figure 2:
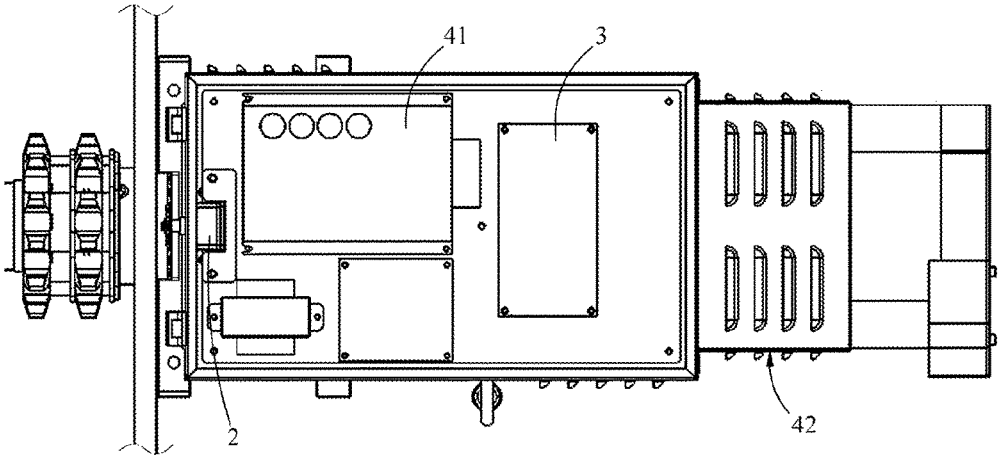
FIG. 2 is a schematic view showing a driving module and a rolling door speed control device of a preferred embodiment according to the invention.
Figure 3:
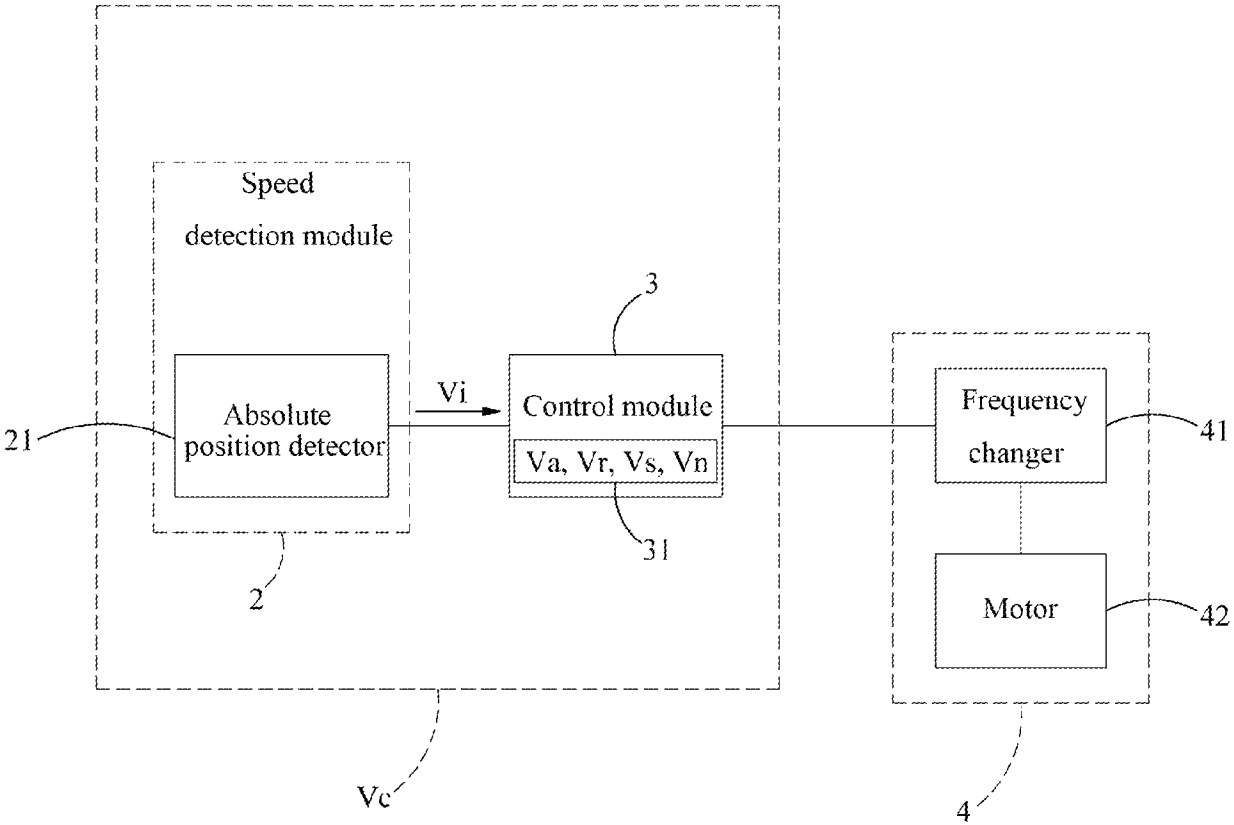
FIG. 3 is a system architecture diagram of a preferred embodiment according to the invention.

Refer to FIGS. 1, 2 and 3, in which FIG. 1 is an overall schematic view of a preferred embodiment according to the invention, FIG. 2 is a schematic view showing a driving module and a rolling door speed control device of a preferred embodiment according to the invention, and FIG. 3 is a system architecture diagram of a preferred embodiment according to the invention. As shown in FIG. 1, a door operator Dm is connected to a door panel D through a transmission chain C, to drive and control opening or closing of the door panel D.

Further, as shown in FIGS. 2 and 3, the door operator Dm according to the embodiment comprises essentially a rolling door speed control device Vc having a speed detection module 2 and a control module 3, and a driving module 4 having a frequency changer 41 and a motor 42. The rolling door speed control device Vc is adapted to control the driving module 4 for opening or closing the door panel D.

The speed detection module 2 is configured to detect a real-time rolling speed Vi of the door panel D, and comprises a real-time position detector 21 for detecting a real-time absolute position of the door panel D. The real-time position detector may apply the device for detecting real-time position of a rolling door as mentioned in the background art. However, the speed detection module 2 provides a real-time rolling speed Vi of the door panel D in accordance with a variation amount per second of a real-time absolute position detected by the real-time position detector 21. Furthermore, a control module 3 is electrically connected with the speed detection module 2 and the driving module 4.

The control module 3 comprises a memory unit 31 configured to store an acceleration value Va, a deceleration value Vr, a range of safety speed values Vs and a standard speed Vn; wherein the acceleration value Va, the deceleration value Vr and the standard speed Vn are all within the range of safety speed values Vs. The control module 3 may be a normal microcontroller unit (MCU) or a control circuit including the microcontroller unit. The memory unit 31 may be any type of stationary or movable random access memory (RAM), read-only memory (ROM), Flash memory, hard disk, or the like, or a combination thereof.

Figure 4:
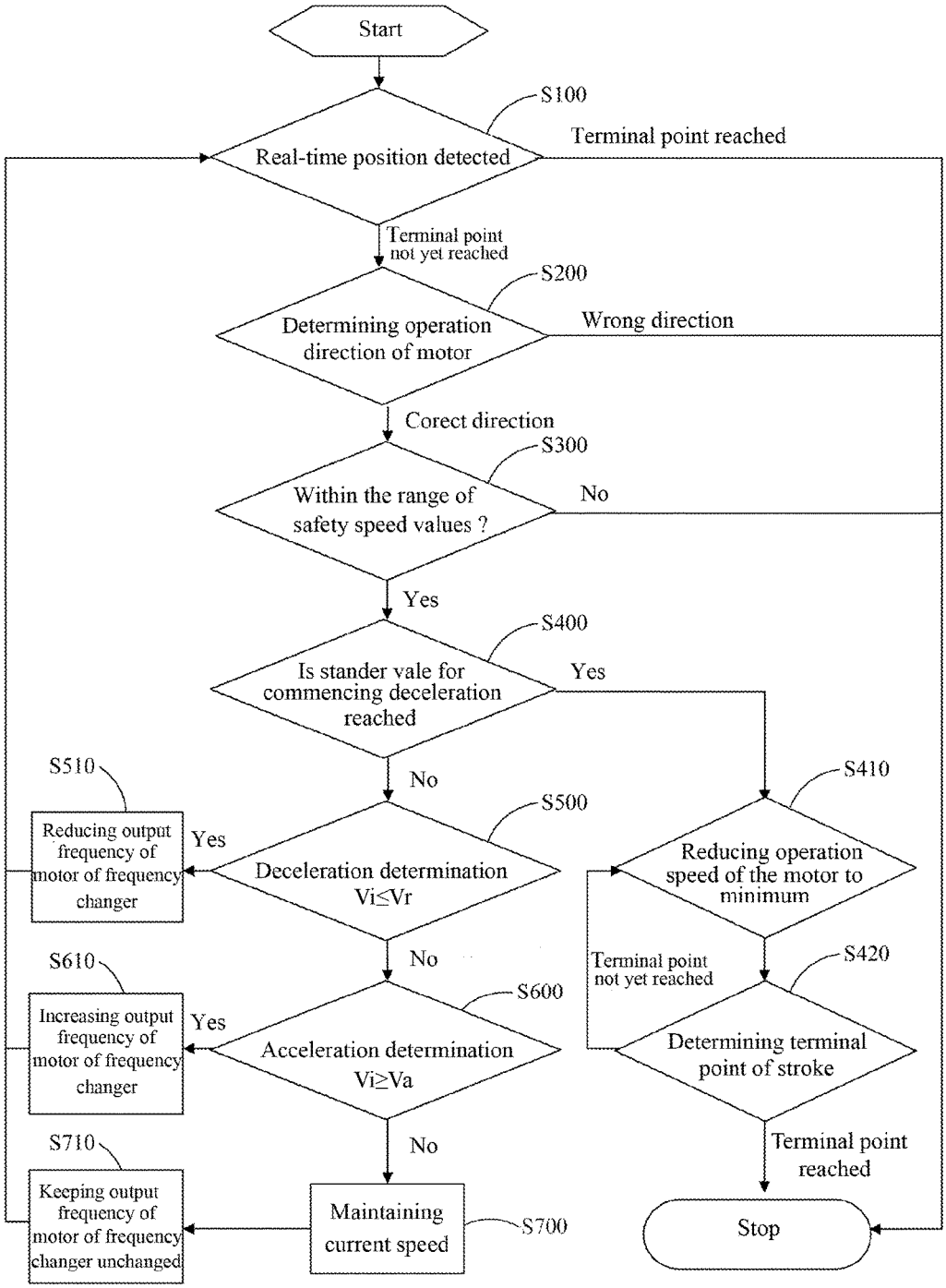
FIG. 4 is a control flowchart of a preferred embodiment according to the invention.

FIG. 4 illustrates a control flowchart according to a preferred embodiment. A control logic of the embodiment is described in detail below: At first, in step S100 as shown in FIG. 4, the real-time position detector 21 detects the real-time position of the door panel D, and stops the operation when the terminal point of the stroke is reached. On the other hand, proceed to the subsequent control step if the real-time position of the door panel D is not the terminal point of the stroke.

Next, in step S200 as shown in FIG. 4, the system determines the operation direction of the motor 42. That is to say, the control module 3 determines the operation direction of the motor 42 based on the fluctuations/variations of the real-time absolute position detected by the real-time position detector 21. In other words, the trend of change of the real-time absolute position is used to determine whether the door panel D is in the opening stroke or the closing stroke. When it is detected that the door panel D operates in a wrong direction, the control module 3 will actuate to stop the operation immediately. On the other hand, proceed to the subsequent control step if it is detected that the operation direction of the motor 42 is correct.

Furthermore, in step S300 as shown in FIG. 4, the system will determine if the real-time rolling speed Vi is within the range of safety speed values Vs or not. When the real-time rolling speed Vi of the door panel D goes beyond the range of the safety speed values Vs, the control module 3 actuates the driving module 4 to stop the opening or closing of the door panel D. In other words, when the operation speed is too fast or slow to render the speed of the door panel D out of control, the control module 3 will take over the control of the driving module 4 to stop the opening or closing of the door panel D immediately, in order to preventany damage or danger. On the other hand, proceed to the subsequent control step if the real-time rolling speed Vi is within the range of safety speed values Vs.

Next, in step S400 as shown in FIG. 4, the system will determine a position before a terminal point of a stroke, at which position deceleration is commenced. A standard speed Vn is preset in the system. Initially, the driving module 4 drives the door panel D to open or close at the standard speed Vn. Under the standard speed Vn, before the terminal point of the stroke, there is a standard position where deceleration commences. In particular, when the door panel D operating at the standard speed Vn reaches the standard position awhere deceleration commences, it starts to decelerate to complete the entire opening or closing stroke so as to provide stability and accuracy for the operation of the door operator Dm. Both the standard speed Vn and the standard position where deceleration commences are default values of the system.

Accordingly, in this step, the system will determine if the door panel D reaches the standard position before the terminal point of the stroke, where deceleration commences. If it is determined that the standard position is reached, the operation speed of the motor will be reduced to its minimum, as shown by step S410. Next, the system will determine if the door panel D reaches the terminal point of the stroke, as shown by step S420. If it is determined that the terminal point is not reached, the motor proceeds to operate at the minimum speed until the terminal point is reached. On the other hand, if the door panel D has not reached the standard position before the terminal point of the stroke, where deceleration commences, proceed to the subsequent control step embodied in a control logic including acceleration, maintaining the original speed, and deceleration.

A variable speed control logic according to the embodiment is detailed below. It is to be noted that step S500 is directed to a deceleration determination step, step S600 is an acceleration step, and step S700 is a current speed maintaining step Nonetheless, the order or sequence of the steps is not to be limited to the embodiment shown herein. The order or sequence of the three determination steps may be changed randomly, or the three steps may proceed simultaneously.

In step S500, the deceleration determination step, the system will determine if the real-time rolling speed Vi of the door panel D reaches the deceleration value Vr. In case the real-time rolling speed Vi is equal to or lower than the deceleration value Vr, the control module 3 will actuate the driving module 4 to speed down the opening or closing of the door panel D. That is to say, the output frequency of the motor 42 of the frequency changer 41 is reduced to achieve deceleration, as shown by step S510. On the other hand, if the real-time rolling speed Vi is higher than the deceleration value Vr, proceed to the subsequent control logic for determination Moreover, in step 600, the acceleration determination step, the system will determine if the real-time rolling speed Vi of the door panel D reaches the acceleration value Va. In case the real-time rolling speed Vi is equal to or higher than the acceleration value Va, the control module 3 will actuate the driving module 4 to speed up the opening or closing of the door panel D. That is to say, the output frequency of the motor 42 of the frequency changer 41 is increased to achieve acceleration, as shown by step S610. On the other hand, if the real-time rolling speed Vi is lower than the acceleration value Va, proceed to the subsequent control logic for determination.

Moreover, in step 700, the current speed maintaining step, if the determination steps S500 and S600 are performed, and the real-time rolling speed Vi of door panel D is between the acceleration value Va and the deceleration value Vr, the control module 3 will actuate the driving module 4 to maintain the current speed. That is, the output frequency of the motor 42 of the frequency changer 41 is not changed, as shown by step S710.

However, the three steps mentioned above proceed in cycle until the door panel D reaches the position before the terminal point of the closing stroke, where deceleration commences. In particular, different real-time rolling speeds Vi would result in different deceleration strokes. For example, in the case of acceleration, the accelerated real-time rolling speed Vi would have gone beyond the standard speed Vn mentioned in step S400. As such, the standard position where deceleration commences is no more applicable, and the actual position where deceleration commences has to be shifted forward.

At this moment, the system will determine the position before the terminal point of the opening or closing stroke of the door panel D, where deceleration commences, based on the real-time rolling speed Vi of the door panel D detected by the speed detection module 2. Likewise, for example, in the case of deceleration, the decelerated real-time rolling speed Vi would be lower than the standard speed Vn mentioned in step S400. As such, the standard position where deceleration commences is no more applicable, and the position where deceleration commences has to be shifted backward.

In short, the system calculates the optimal distance before the terminal point of a stroke to provide the deceleration action that operates under the minimum speed before the terminal point of the stroke based on the differences in the real-time rolling speed Vi of the door panel D, and the information of the position provided by the real-time position detector 21. As such, the accuracy of the position of the terminal point of the stroke will not be influenced by therotational speed of the motor 42 which is varied during braking.

While the preferred embodiments have been described as above, it is to be noted that the description and accompanying drawings disclosed herein are not intend to restrict the scope of implementation of the present invention. Variations and modifications equivalent to the above embodiments and able to be realized are considered to be within the scope of the present invention.

The invention claimed is:

1. A speed control device of a rolling door for controlling a driving module to open or close a door panel, the device comprising:

a speed detection module for detecting a real-time rolling speed of the door panel; and a control module electrically connected with the speed detection module and the driving module;

wherein, when the real-time rolling speed of the door panel reaches a predetermined acceleration value, the control module actuates the driving module to speed up opening or closing of the door panel; when the real-time rolling speed of the door panel reaches a predetermined deceleration value, the control module actuates the driving module to speed down opening or closing of the door panel; when the real-time rolling speed of the door panel is in between the acceleration value and the deceleration value, the control module actuates the driving module to maintain the opening or closing speed of the rolling door at current value.

2. The rolling door speed control device as claimed in claim 1, wherein the speed detection module comprises a real-time position detector adapted to detect a real-time absolute position of the door panel; the speed detection module obtains the real-time rolling speed of the door panel in accordance with the variation amount per second of the real-time absolute position.

3. The speed control device as claimed in claim 1, wherein the control module is adapted to set up a position before a terminal point of an opening or closing stroke of the door panel, at which position the opening or closing speed of the door panel is configured to commence deceleration according to the real-time rolling speed of the door panel detected by the speed detection module.

4. The speed control device as claimed in claim 2, wherein the control module determines the door panel is in the opening or closing stroke based on the fluctuations of the real-time absolute position detected by the real-time position detector.

5. The speed control device as claimed in claim 1, wherein the control module comprises a memory unit configured to store the acceleration value, the deceleration value and a range of safety speed values; the acceleration and deceleration values are within the range of safety speed values; when the real-time rolling speed of the door panel goes beyond the range of the safety speed values, the control module actuates the driving module to stop the opening or closing of the door panel.

6. A method for controlling the speed of a rolling door by controlling a driving module to open or close a door panel, the method comprising the steps of:

(A) providing a control module to actuate a speed detection module to detect a real-time rolling speed of the door panel; and (B) configuring the control module to control the driving module to open or close the door panel according to the following conditions;

wherein, when the real-time rolling speed of the door panel reaches a predetermined acceleration value, the control module actuates the driving module to speed up opening or closing of the door panel; when the real-time rolling speed of the door panel reaches a predetermined deceleration value, the control module actuates the driving module to speed down opening or closing of the door panel; when the real-time rolling speed of the door panel is in between the acceleration value and the deceleration value, the control module actuates the driving module to maintain the opening or closing speed of the rolling door at current value.

7. The method as claimed in claim 6, wherein the speed detection module provides a real-time rolling speed of the door panel in accordance with a variation amount per second of a real-time absolute position of the door panel detected by a real-time position detector.

8. The method as claimed in claim 6, wherein the control module is adapted to set up a position before a terminal point of an opening or closing stroke of the door panel according to the real-time rolling speed of the door panel detected by the speed detection module.

9. The method as claimed in claim 6, wherein the control module determines the door panel is in the opening or closing stroke according to the fluctuations of the real-time absolute position detected by the real-time position detector.

10. The method as claimed in claim 6, wherein when the real-time rolling speed of the door panel goes beyond a range of the safety speed values, the control module actuates the driving module to stop the opening or closing of the door panel.

* * * * *